United States Patent [19]

Kampichler et al.

[11] Patent Number: 4,928,643

[45] Date of Patent: May 29, 1990

[54] STARTER HAVING A MANUAL DRIVE FOR INTERNAL COMBUSTION ENGINES

[75] Inventors: Guenter Kampichler, Ruhstorf; Erich Eder, Vornbach am Inn, both of Fed. Rep. of Germany

[73] Assignee: Motorenfabrik Hatz GmbH & Co. KG, Ruhstorf, Fed. Rep. of Germany

[21] Appl. No.: 349,697

[22] Filed: May 10, 1989

[30] Foreign Application Priority Data

May 11, 1988 [DE] Fed. Rep. of Germany ..... 3816099

[51] Int. Cl.[5] ..... F02N 3/02

[52] U.S. Cl. ..... 123/185 B; 74/7 C; 192/42

[58] Field of Search ..... 123/185 A, 185 B, 185 B A, 123/185 S; 74/7 C; 192/42

[56] References Cited

U.S. PATENT DOCUMENTS

| | | | |
|---|---|---|---|
| 2,278,547 | 4/1942 | Herrington | 123/179 |
| 2,848,987 | 8/1958 | Morden | 123/185 B A |
| 3,782,356 | 1/1974 | Hamman | 123/185 S |
| 4,641,614 | 2/1987 | Krebs | 123/185 B A |
| 4,841,614 | 6/1989 | MacNitt et al. | 29/156.88 |

*Primary Examiner*—Andrew M. Dolinar

*Attorney, Agent, or Firm*—Flynn, Thiel, Boutell & Tanis

[57] ABSTRACT

A rewind or recoil starter for an internal combustion engine which is adapted to be coupled to the engine element to be started, and which is returned to its resting position by a rewind or recoil device after manual operation of its actuating structure and after the engine has started. A safety device in the starter is provided which, in the event of an unsuccessful starting operation and upon kick-back of the engine element against the starting direction, uncouples the actuating structure of the starter from the back-kicking engine element. The starter is equipped with a driven member rigidly seated on the engine element to be started, and with a driving member which, during starting, is driven by way of the actuating structure to drive the engine element in the starting direction. The safety device includes a fixedly mounted, spring-loaded decoupler pawl which does not affect the driving engagement between the driven member and the manually operated driving member when the elements of the starter are in their resting positions and during their starting movement, whereas, upon kick-back of the engine element to be started, the decoupler pawl is brought into a decoupling position by an element which then kicks back, and thereby releases the driving engagement.

4 Claims, 2 Drawing Sheets

STARTER HAVING A MANUAL DRIVE FOR INTERNAL COMBUSTION ENGINES

FIELD OF THE INVENTION

The invention relates to rewind or recoil starters for internal combustion engines which are coupled to the engine element to be started, such as the crankshaft. Starters of this kind comprise a manually actuated means (cord pull with handle) for operating the starter. After the engine has started, said manually actuated means is brought into its resting position by a rewind or recoil device.

BACKGROUND OF THE INVENTION

Misfiring or the like frequently occurs in the case of manually operated starters as a result of generally known, undesired circumstances in the engine to be started, and continue as kick-backs to the elements of the starter which are actuated manually by the operator. In the case of starters for low-power internal combustion engines, such as engines used on lawnmowers, these kick-backs rarely lead to any serious incidents, such as injury to the operator. However, in the case of larger engines, a strong kick-back may lead to serious injury to the operator's hand or even to bodily injury if the operator is pulled violently against the walls of the machine itself or against the units carrier thereby as a result of an abrupt, violent kick-back on the operating cord of the starter.

For the purpose to avoid disadvantages of this kind, a safety means is provided in the known starters and, in the event of an unsuccessful starting operation and upon kick-back of the engine element to be started against the starting direction, said safety means uncouples the actuating means of the starter from the back-kicking engine element.

It is an object of the present invention to develop a safety means having a simple construction and a secured operation. In accordance with the invention, the starter is equipped with a driven member which is rigidly seated on the engine element to be started, and with a driving member which, during starting, is driven by way of an actuating means in the form of a pulley having a cord and pull handle for the cord and drives the engine element in the starting direction, and the safety means is in the form of a fixedly mounted, spring-loaded decoupler pawl which does not affect the driving engagement between the driven member and the manually operated driving member when the starter elements are in their resting positions and during their starting movement, whereas, upon kick-back of the engine element to be cranked, the pawl is brought into the decoupling position by means of an element which then kicks back, and thereby releases the driving engagement.

It is advantageous if the driven member comprises a cup-shaped bell whose periphery is provided with a plurality of openings, and if the driving member comprises a spring-loaded drive pawl mounted on the pulley and is adapted to engage by means of its drive nose into one of the openings under spring force and carries along the driven member during the starting movement, and if the decoupling pawl is held by its spring in its remote position outside the range of movement of the driven member during the starting movement whereas, upon a kick-back movement, the decoupling pawl is brought by the back-kicking driven member into engagement in one of the openings and pivots the drive pawl out of the opening and into a position outside the range of movement of the driven member, whereby the driving engagement between the driven member and the drive pawl momentarily kicking back with the pulley is released.

Furthermore, the arrangement may be designed in such a way that the decoupling pawl is a one-armed pawl, whose associated spring seeks to urge it into a remote position outside the range of movement of the driven member and against a resilient stop.

It is also advantageous to construct the arrangement in such a way that, at least when the starter elements are in their normal resting positions, the drive nose of the driving pawl projects through one of the openings into the region outside the driven member where drive nose co-operates with the decoupler nose of the decoupler pawl.

BRIEF DESCRIPTION OF THE DRAWINGS

The invention is further described by way of example, with reference to the accompanying drawings, in which.

DETAILED DESCRIPTION

Figure 1:
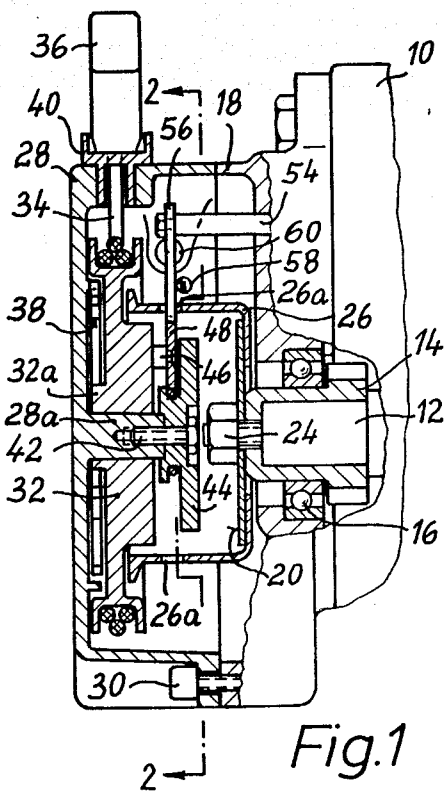
FIG. 1 is a longitudinal sectional view through a pull starter in its normal position.

Referring to FIG. 1, a crankshaft is journalled in a crankcase 10 of an internal combustion engine (not further illustrated). Only that end 12 of the crankshaft is visible to which a bearing bush 14 is secured by, for example, pressing it onto the end. A ball bearing 16 serves to journal the end 12 of the crankshaft in a crankcase cover 18 bolted to the crankcase 10. A cup-shaped driven bell 26 is secured to the end face of the bearing bush 14 by means of a screw 24 with a retaining ring 20 interposed therebetween, a plurality of openings **26*a*** being provided in the cylindrical periphery of said driven bell.

A starter housing 28 is secured to the crankcase cover 18 by means of bolts 30. A trunnion **28*a* in the axial center of the housing 28 serves as a pivot axis for a starter cord pulley 32 to which one end of a pull cord 34 is anchored. The pull cord is wound several times around the pulley 32 and its other end extends out of the starter housing 28 where it is fixedly connected to a handle 36. One end of a spiral spring 38 (FIG. 3) is secured to the starter housing 28 at 38*a*, and the other end of the spiral spring is secured to a hub 32*a* of the pulley 32. When the pull starter is in its resting position (FIGS. 1 and 2), the spiral spring 38 draws the cord handle 36 to a stop position in a receiving member 40 connected to the starter housing 28**.

Figure 2:
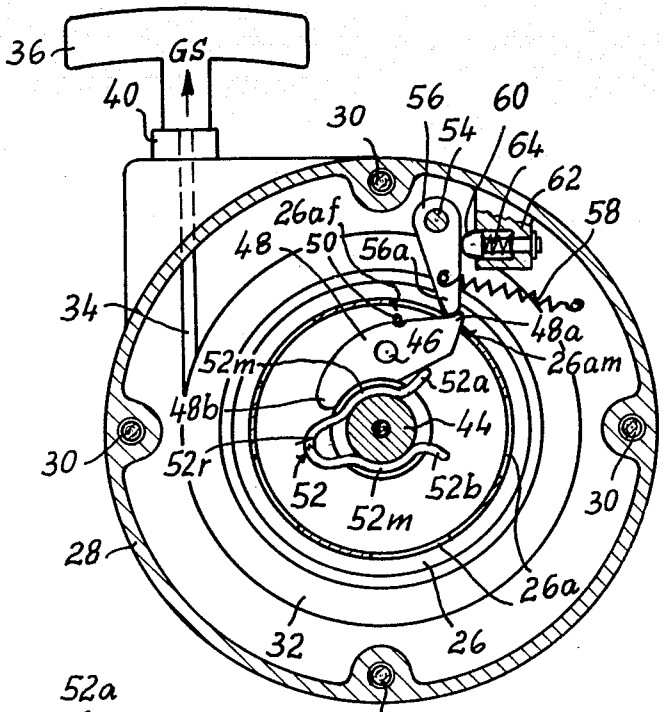
FIG. 2 is a cross section taken on the line II—II of FIG. 1.
Figure 3:
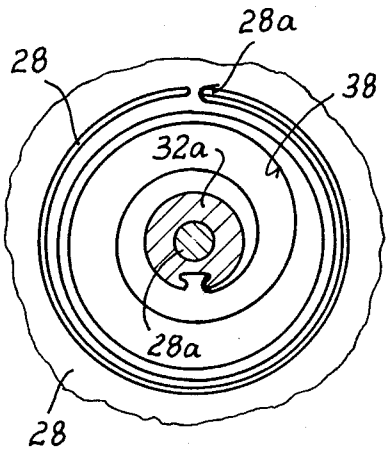
FIG. 3 is a cross section through a detail of the starter.

A retaining disc 44 is fixedly secured to the trunnion 28*a* by means of a screw 42. A driving member in the form of a drive pawl 48 is pivotably mounted on a bearing pin 46 (FIG. 2) which is rigidly mounted in the pulley 32, and a resiliently flexible rod spring 50 also rigidly anchored in the pulley 32 permanently engages the drive pawl 48 and rotatably biases the drive pawl 48 in a clockwise direction (FIG. 2).

Figure 4:
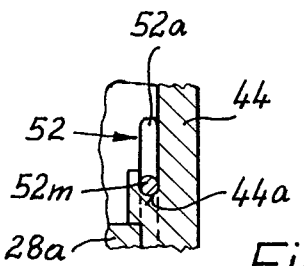
FIG. 4 is a cross section through a further detail, drawn to a larger scale.

A hairpin spring 52 is also provided, the limbs 52*a* and 52b of which hairpin spring diverge, while its medial portions 52*m* on each side are of arcuate configuration and engage an annular groove 44*a* in the fixed retaining disc 44 under the action of inherent spring force. The hairpin spring 52 is retained in the annular groove 44*a* positively in the axial direction of the starter (FIG. 4) Nevertheless, the hairpin spring 52 can be turned slightly in the annular groove 44*a* when greater pressure in exerted on one of its limbs 52*a* or 52*b*. The limb 52*a* of the hairpin spring abuts against the bottom longitudinal side of the drive pawl 48 and hence acts against the force of the weaker rod spring 50.

A decoupler pawl in the form of a one-arm pawl 56 is pivotably mounted on a bearing pin 54 secured relative to the housing 28, in such a way that the decoupler pawl 56 lies in the same plane as the drive pawl 48. The pawl 56 has an associated spring 58 which, as is shown in FIG. 2, seeks to pivot the pawl 56 in a counter-clockwise direction, wherein the pawl then abuts against a stop 60 which can yield resiliently in a holder 62, fixed relative to the housing 28, against the force of a spring 64, the spring 58 being somewhat weaker than the spring 64. The nose 56*a* of the pawl 56 is then in abutting engagement with the nose 48*a* of the drive pawl 48, projecting through one of the openings 26*a*.

The starter is shown in its normal resting position in FIG. 1, the handle 36 of the cord being in abutment with the stop 40 under the action of the spiral spring 38. If the engine is to be started, the operator grips the cord handle 36 and pulls it out in the direction of the arrow Gs together with the end of the cord 34. The pulley 32 and the drive pawl 48 are then jointly rotated around the trunnion 28*a* in the direction of the arrow S, and its pawl nose 48*a*, which is engaging one of the openings 26*a* and abutting against the edge 26*am* at this location, carries the driven bell 26 along in the same rotational direction. Approximately three revolutions of the starter elements are normally sufficient to start the engine.

Figures 5, 6, 7, 8:
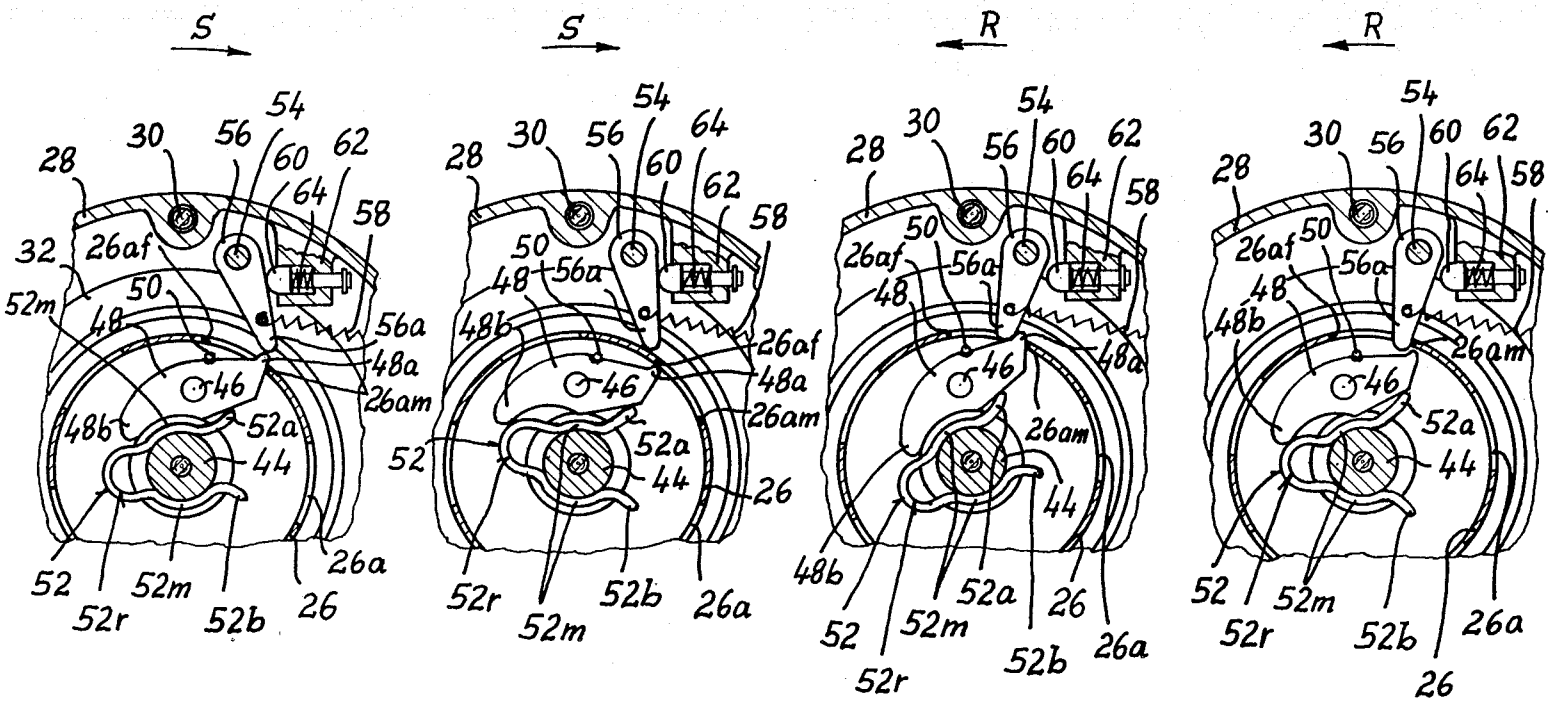
FIG. 5 is a cross section similar to FIG. 2 and showing the starter elements after a few starting revolutions.
FIG. 6 shows the starter elements shortly after the showing in FIG. 5 and after the starting operation and when the engine is running.
FIGS. 7 and 8 show the starter elements upon the occurrence of a kick-back from the engine element to be cranked.

During rotary movements of the driven bell 26 in the direction S, the spring 58 of the decoupler pawl 56 holds the latter in the stop position at 60 outside the region of rotation of the driven bell 26 and its openings 26*a* or, alternatively, the nose 48*a* of the drive pawl 48, coming from the other side during the next rotary movement in the direction S, strikes against the nose 56*a* of the decoupler pawl 56 and pivots the latter further in an anti-clockwise direction and further depresses the stop 60 against the force of the spring 64 (FIG. 5). After the engine has started, the driven bell 26 connected to the crankshaft moves rapidly in the direction S in advance of the drive pawl 48, whereby the nose 48*a* of the drive pawl 48 is pressed inwardly by the edge 26*af* of each opening 26*a* against the action of the limb 53*a* of the hairpin spring 52 and does not obstruct the rapid forward movement of the engine elements 12, 14 (FIG. 6).

As soon as the operator releases the cord handle 36 after the engine has started, the pulley 56 rotates in the opposite direction to the arrow S under the action of the spiral spring 38, and the starter elements return to their resting positions. The nose 48*b* at the end of the drive pawl 48 remote from the nose 48*a* then encounters the rear 52*r* of the hairpin spring 52, the drive pawl being thereby pivoted in a clockwise direction in such a way that its nose 48*a* is moved inwardly, that is, out of the region of the cylindrical periphery of the driven bell 26 rotating rapidly in the direction S together with the engine elements 12, 14 and out of the region of the openings 26*a* in the driven bell (similarly to FIG. 6). Hence, the starter elements can return to their normal resting positions in an unobstructed manner after the engine has started.

However, if a kick-back occurs during the starting operation of the engine and drives the elements in the opposite direction to the starting direction, that is, in direction R (FIGS. 7 and 8), the drive pawl 48 is also momentarily moved in the direction R by the edge 26*am* of an opening 26*a* of the driven bell 26 and its nose 48*a* moves the decoupler pawl 56 in a clockwise direction by way of the nose 56*a* of the decoupler pawl 56 in abutting engagement with the nose 48*a*, whereby the drive pawl 48 itself is in turn moved in a counter-clockwise direction (FIG. 7). The underside of the drive pawl 48 presses against the limb 52*a* of the hair-pin spring 52 and the latter is turned slightly in a clockwise direction in its reception groove 44*a* against the frictional engagement which otherwise holds the said hairpin spring. The rear 52*r* then holds the drive pawl 48 in the disengaged position relative to the driven bell 26, 26*a* (FIG. 8). Engagement between the elements 48 and 26 is then released.

Thus, the coupling connection between engine element to be started and the starter elements is released after a short kick-back phase, so that the operator's hand and/or body cannot be injured.

After the coupling connection has been released, and after the starter elements have returned to their normal position, the nose 56*a* of the decoupler pawl 56 either remains against the periphery of the driven bell 26, or it drops into one of the openings 26*a*, according to the end position of the elements. In both cases, the decoupler pawl 56 is moved in a counter-clockwise direction by the edge 26*af* of one of the openings 26*a* upon a fresh starting operation in the direction S, and again assumes its engagement position relative to the drive pawl in accordance with FIG. 2.

With regard to the question of material, it may be mentioned in conclusion that the parts of the housing of the starter are made from metal, preferably from die-cast aluminum. Other starter elements subjected to greater stress and wear will also be made from suitable material. On the other hand, elements which are subjected to less stress, such as the pulley and core handle, can readily be made as mass-produced parts from a harder plastics material (such as PVC). The springs which are used are made from spring steel of adequate resilience.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A rewind or recoil starter for an internal combustion engine which is adapted to be coupled to the engine element to be started, and which is returned to its resting position by a rewind or recoil device after manual operation of its actuating means and after the engine has started, comprising at least one safety means in the starter which, in the event of an unsuccessful starting operation and upon kick-back of said engine element against the starting direction, uncouples the actuating means of the starter from the back-kicking engine element, said starter being equipped with a driven member rigidly seated on said engine element to be started, and with a driving member which, during starting, is driven by way of said actuating means, in the form of a pulley having a cord and a cord handle, to drive said engine element in the starting direction, said safety means comprising a fixedly mounted, spring-loaded decoupler pawl which does not affect the driving engagement between the driven member and the manually operated driving member when the elements of the starter are in their resting positions and during their starting movement, whereas, upon kick-back of the engine element to be started, the decoupler pawl is brought into a decoupling position by means of an element which then kicks back, and thereby releases the driving engagement.

2. A starter as claimed in claim 1, in which the driven member comprises a cup-shaped bell, the periphery of which is provided with a plurality of openings, and the driving member comprises a spring-loaded drive pawl mounted on the pulley and adapted to engage by means of its drive nose into one of the openings under the force of at least one spring and carries along the driven bell during the starting movement, and in which the decoupling pawl is held by its spring in a remote position outside the range of movement of the driven bell during the starting movement, whereas, upon a kickback movement, the said decoupling pawl is brought by the back-kicking driven bell into engagement in one of the openings and pivots the drive pawl out of the opening and into a position outside the range of movement of the driven bell, whereby the driving engagement between the driven bell and the drive pawl momentarily kicking back upon the pulley is released.

3. A starter as claimed in claim 2, in which the decoupler pawl is a one-armed pawl, and its associated spring biases it into a remote position outside the range of movement of the driven member and against a resilient stop.

4. A starter as claimed in claim 3, in which, at least when the elements are in their normal positions, the drive nose of the drive pawl projects through one of the openings into the region outside the driven bell where said drive nose cooperates with the decoupler nose of the decoupler pawl.

* * * * *